United States Patent [19]

VanderWyde

[11] 4,422,313

[45] Dec. 27, 1983

[54] CONTAINER INSIDE LOCKING SYSTEM

[76] Inventor: James VanderWyde, 1730 NW 87 Ave., Plantation, Fla. 33322

[21] Appl. No.: 308,812

[22] Filed: Oct. 5, 1981

[51] Int. Cl.[3] ..... B65D 55/14; E05B 65/08; E05C 3/06; E05C 9/16

[52] U.S. Cl. ..... 70/167; 70/99; 70/121; 292/26; 292/48

[58] Field of Search ..... 70/121, 122, 123, 139, 70/158, 159, 160, 161, 162, 163, 164, 165, 166, 167, 168, 169, 170, 171, 172, 173, 202, 211, 95–100; 292/26, 48, 196, DIG. 32

[56] References Cited

U.S. PATENT DOCUMENTS

| | | | |
|---|---|---|---|
| 1,434,492 | 11/1922 | Johnson | 70/161 |
| 1,988,360 | 1/1935 | Moore | 70/168 |
| 2,677,338 | 5/1954 | Sassetti | 70/169 |
| 2,685,191 | 8/1954 | Ford | 70/169 |

FOREIGN PATENT DOCUMENTS

| | | | |
|---|---|---|---|
| 474134 | 3/1929 | Fed. Rep. of Germany | 70/DIG. 32 |
| 601545 | 5/1948 | United Kingdom | 70/123 |

*Primary Examiner*—Robert L. Wolfe
*Attorney, Agent, or Firm*—Malin & Haley

[57] ABSTRACT

An enclosed locking system for transportable commercial containers having swinging or roll-up access doors. A main feature of this locking system is that it renders the locked container virtually tamper-proof. Only the key access hole is externally accessible. This locking system may be added to existing containers or incorporated into new units. The system is fitted into the container horizontal frame member positioned at the lower edge of the access doors. The locking system comprises two main sub-assemblies, a cam lock housing and a removable lock assembly. The cam lock housing is bolted or welded to the container frame member, while the lock assembly is removable after a locking bolt therein is disengaged from a portion of the cam lock housing by key operation. When the lock assembly is so removed, it exposes a cam actuator lever which, when pivoted, disengages at least one cam lock from a cavity in the lower horizontal edge of the access doors, allowing entry. When this locking system is used in conjunction with a pair of swinging doors, follower bars passing through the vertical length of the doors and operably positioned to lockably engage or disengage the upper horizontal door frame member of the container in response to cam lock rotation may be incorporated into this locking system.

4 Claims, 7 Drawing Figures

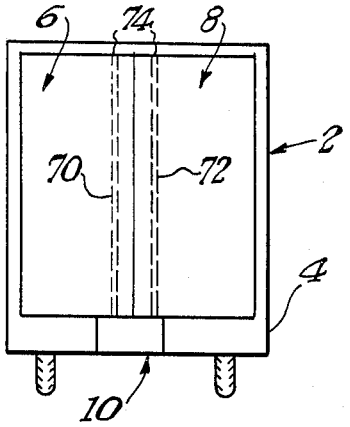
Fig.1.
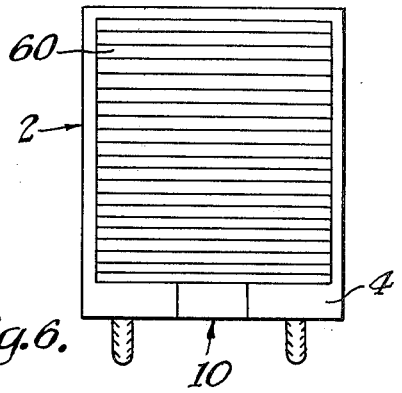
Fig.6.
Fig.3.
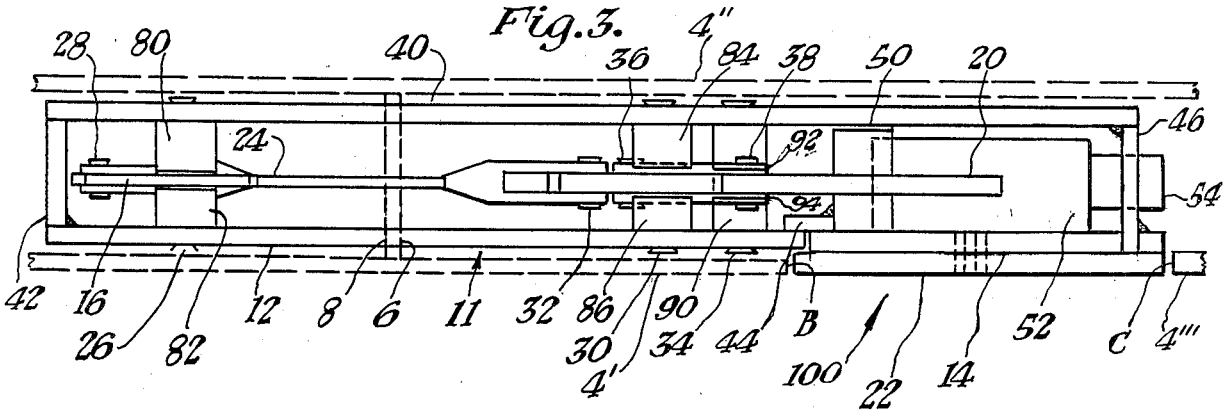
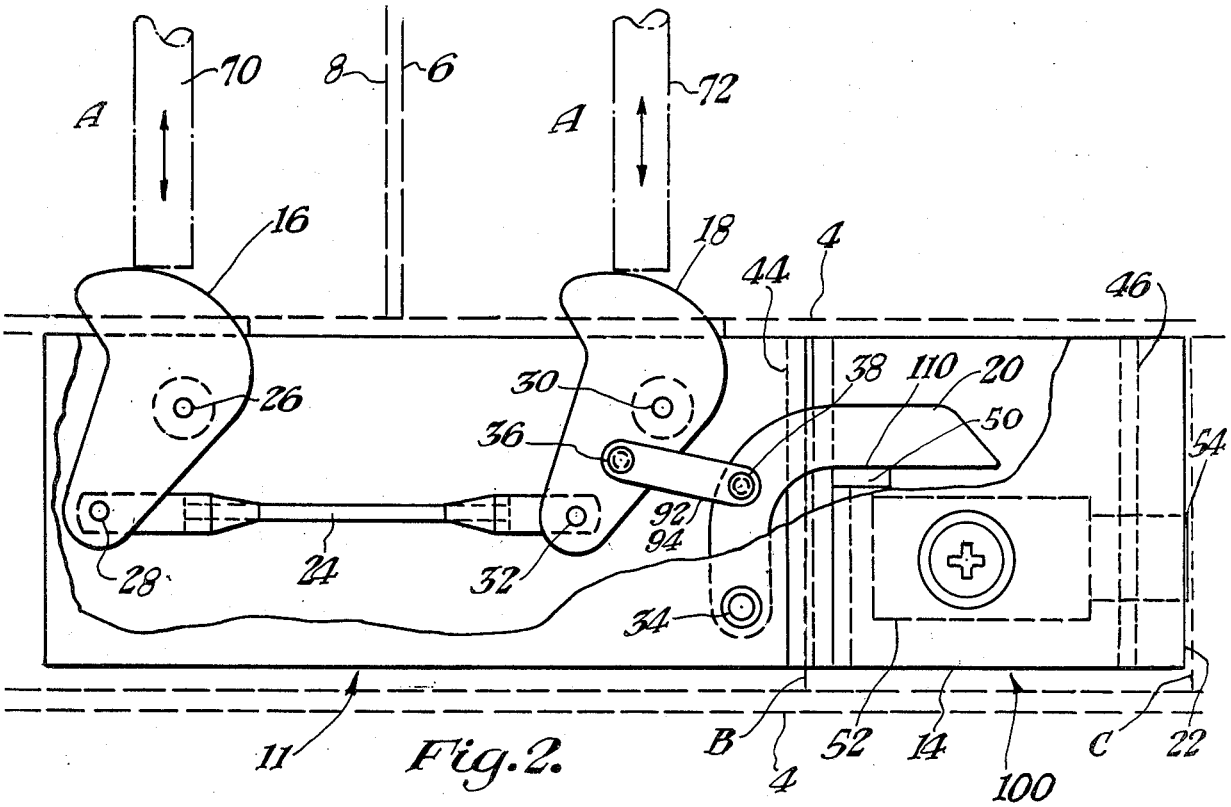
Fig.2.

CONTAINER INSIDE LOCKING SYSTEM

BACKGROUND OF THE INVENTION

Transportable commercial containers used in shipping, flying and trucking goods in commerce require a secure locking system to prevent tampering or theft of their contents. Locking systems currently used, while appearing to render these containers secure, nonetheless remain in jeopardy because at least one crucial member of the locking system is exposed and thus vulnerable to disengagement or distruction by determined criminals. The present invention provides a locking system which may be added to existing containers or containers in the process of being manufactured, rendering the access doors of these containers, whether a pair of swinging doors or at least one roll-up door, virtually tamperproof. All of the parts to this locking system are concealed or otherwise shielded from forceable disengagement or distruction.

BRIEF DESCRIPTION OF THE INVENTION

An improved commercial shipping container door locking system comprising a cam lock housing and a removable lock assembly. The cam lock housing, made an integral part of the container lower horizontal door frame member by suitable attaching means, includes a cam actuator lever, at least one cam lock, and interconnecting linkage which translates manual pivoting motion of the exposed cam actuator lever into rotational engagement or disengagement of the cam lock with the container door. The lock assembly includes a dead-bolt type lock and suitable cam lock housing engaging plate so that, when this lock assembly is locked into position adjacent the cam lock housing, after the cam lock has properly engaged the closed door or doors, the lock assembly covers the cam actuator lever, shielding it from any form of prying, tampering, or destructive devices.

In one embodiment, used in conjunction with swinging container doors hinged at their outer edges, the cam lock housing includes a pair of cam locks which pivot in the plane of the doors in response to manual pivotal movement of the cam actuator handle in the same plane of the doors. The cam locks profile moves up and down as they are pivoted to engage or disengage an integral slot in the lower horizontal edges of door, thus locking or releasing the doors. In a second embodiment, the upper edge profile of the cam locks may also be made to linearly actuate a separate pair of vertical follower bars slidably housed within the doors. At the same time the cam locks are lockably engaging the lower door edge slots, the follower bars riding upwardly on the cam lock edge profile, lockably engage a mating slot or cavity in the upper horizontal door frame member. A biasing means between the upper door frame and each follower bar moves each follower bar downward to disengage the upper horizontal frame member when the cam locks are rotatably unlocked.

In a third embodiment of the instant invention, used in conjunction with one or more roll-up container doors, one or more cam locks include a slot therein, which lockably engages or disengages a horizontal cross bar fixed in the lower edge of each door. In this embodiment, vertical follower bars are superfluous.

It is an object of this invention to provide a totally concealed theft-resistant locking system for the access doors of a transportable shipping container.

It is another object of this invention to provide a concealed totally theft-resistant locking system for the access doors of existing transportable shipping containers as well as containers currently in manufacture.

It is yet another object of this invention to provide a totally concealed theft-resistant locking system for both double outwardly swinging as well as roll-up type access doors of a transportable shipping container.

BRIEF DESCRIPTION OF THE DRAWINGS

FIG. 1 is a rear elevation view of a transportable shipping container on a trailer showing outwardly swinging access doors and the relative positioning of two embodiments of the instant invention.

FIG. 2 is a fractured rear elevation view of two embodiments of the instant invention.

FIG. 3 is a top plan view of the instant invention.

FIG. 6 is a rear elevation view of a transportable shipping container on a trailer showing a roll-up access door and the relative positioning of another embodiment of the instant invention.

PREFERRED EMBODIMENT OF THE INVENTION

Figure 7:
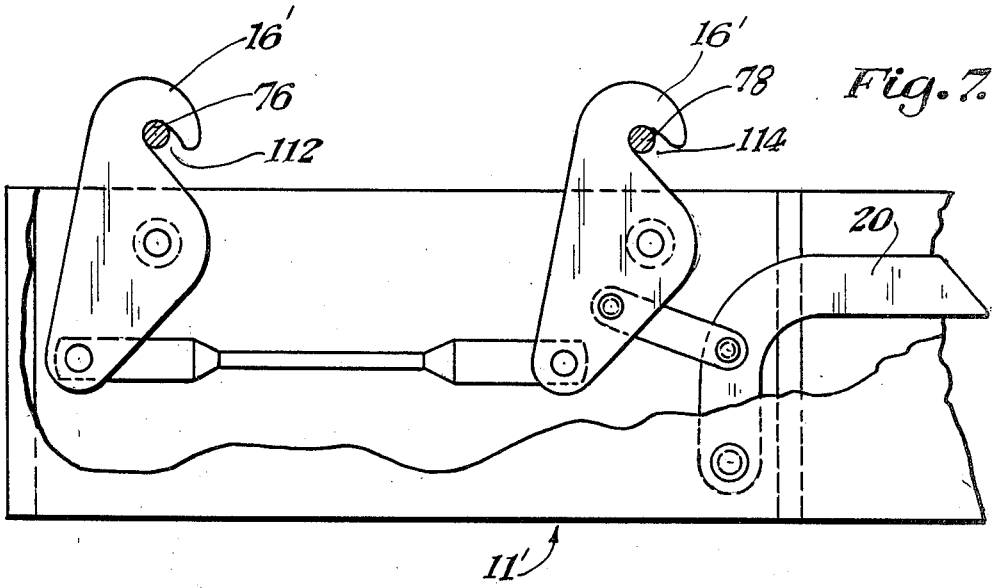
FIG. 7 is a fractured rear elevation view of another embodiment of the cam lock housing portion of the instant invention used in conjunction with one or more roll-up access doors.

Referring now to the drawings and particularly to FIG. 1, a conventional transportable shipping container 2 having outwardly swinging doors 6 and 8 and being used in trailer form is shown from a rear view. The instant invention 10 is positioned as shown in the container lower transverse frame member 4. FIGS. 2 and 3 show the elements of one embodiment of the invention to be a cam lock housing 11 and a lock assembly 100. Cam lock housing 11 is rigidly fixed into a suitably prepared opening in the transverse frame member 4 by attaching back housing plate 40 thereto using suitable fastening means. Cam actuator 20 and cam locks 16 and 18 are held between plate 40 and front housing plate 12 by suitable fasteners 26, 30 and 34 which pass through cam lock positioning spacers 80, 82, 84, 86, 88 and 90 and also interconnect plates 12 and 40. Fasteners 26, 30 and 34 are not removable by someone outside the container when this system is locked because the access hole in lower frame member 4 extends only from line B to line C. By pivoting lever 20, clockwise about fastener 34 as viewed in FIG. 2, cam locks 16 and 18 are made to rotate in a counterclockwise direction as viewed about their respective fasteners 26 and 30 by interconnecting linkages 24, 92 and 94. As cam locks 16 and 18 so rotate, their upper edge profile withdraws from a mating internal slot in the lower horizontal edges of doors 6 and 8.

Figure 5:
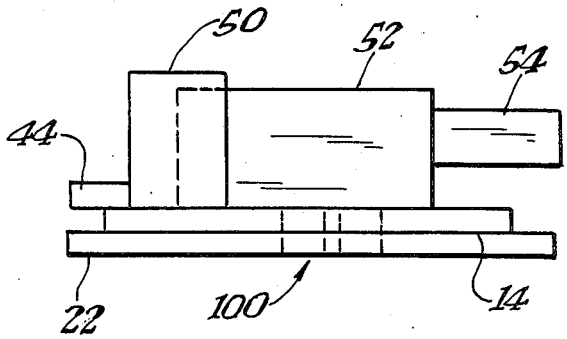
FIG. 5 is a top plan view of the lock assembly.
Figure 4:
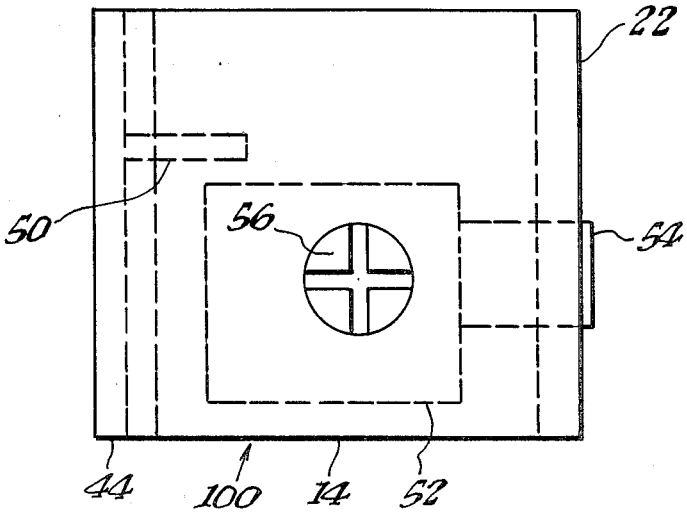
FIG. 4 is a rear elevation view of the lock assembly.

Lever 20 is rendered totally inaccessable from outside the container by installing lock assembly 100 as shown in FIGS. 2 and 3. As shown in FIGS. 4 and 5, lock assembly 100 includes a lock plate 14 having a central thru-keyhole, a dead-bolt type lock 52 connected to the inside surface and operably postioned to the thru-hole in lock plate 14, a positioning plate 50 perpendicularly disposed and integral to the inside surface of lock plate 14, a shield plate 44 integral to the inside surface of and partially extending beyond the edge of cover plate 14, and a cover plate 22 integral to the outside surface of lock plate 14 and extending beyond each vertical edge of plate 14. Cover plate 22 includes a keyhole mating with those in lock 52 and plate 22. Lock assembly 100 is held in position adjacent cam lock housing 11 when bolt 54 of lock 52 is made to pass through a mating through hole in bolt channel 46 equal in width, integral and perpendicular to one end of back houing plate 40. When lock assembly 100 is so positioned, lever 20 is made virtually inaccessable, thereby rendering the door theft-proof. Positioning plate 50 also serves as a locked position stop for lever 20, contacting at numeral 110 of FIG. 2. Plate 50 also serves as an open position stop for lever 20 so that the lock assembly may be stored in position with the doors unlocked as well as adding strength against caving in forces applied to cover plate 14. As viewed in FIG. 3, end plate 42, equal in width, integral and perpendicular to one end of plate 12, completes the enclosure perimeter. FIGS. 1 and 2 also show an alternate embodiment of this invention available for use with outwardly swinging doors, which includes vertical follower bars 70 and 72. These follower bars are slidably housed within doors 6 and 8 and operably positioned above cam locks 16 and 18 so as to be vertically lifted by the cam lock upper edge profile as they are lockably rotated clockwise, as viewed, by lever 20. As followers 70 and 72 are so lifted, they engage mating slots or cavities in the container upper horizontal door frame at 74 in FIG. 1, thus acting as a secondary locking means. Biasing means (not shown) between the upper horizontal door frame 74 and the follower bars disengage the follower bars from the upper frame member when the cam locks are released from the doors.

A third embodiment of the instant invention 10' is shown generally in FIG. 6, to be used with at least one roll-up container access door 60. Referring to FIG. 7, cam locks 16' and 18' include slots 112 and 114 which lockably engage horizontal cross bars 76 and 78, integral to a cavity in the lower edge of the roll-up door, when lever 20 is pivoted counter-clockwise as viewed to the position shown after removal of the lock assembly (not shown).

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A concealed theft-resistant locking system for use in locking the access door system of commercial transportable shipping containers, said locking system operably positioned within the horizontal transverse frame member beneath the access door system, said locking system comprising:

a cam lock assembly having a housing, a cam actuator lever, at least one cam lock, and interconnecting linkage between said lever and said cam lock;

said lever and said cam lock mounted for rotation within said housing;

said linkage operably connected between and translating the pivoting movement of said lever into rotation of said cam lock;

said cam lock rotation effectuating locking engagement or releasing disengagement of said cam lock into a locking cavity in the lower edge of the access door system; and a removable lock assembly having a lock plate with a generally central key hole, a dead-bolt lock connected to the inner surface of said lock plate, a cover plate integral to and covering the outer surface of and partially extending beyond each vertical edge of said lock plate and having a generally central key hole, and a positioning plate integral and perpendicular to the inner surface of said lock plate;

said cover plate engaging adjacent the outer surface of the adjacent said housing to securely position one side of said lock assembly;

said dead-bolt lock releasably engaging said housing to securely position the other side of said lock assembly;

said cover plate preventing insertion of tools to disengage said locking system when said lock assembly is in place;

said key holes in said lock plate and said cover plate positioned so that a key will pass through said key holes into said lock;

said lock assembly enclosing said lever to prevent access to said lever;

said positioning plate contacting and securing said lever in either a lever-open position or a lever-locked position in relation to said cam lock.

2. A concealed theft-resistant locking system as recited in claim 1 wherein said lock assembly further includes a shield plate integral to the inner surface of and partially extending beyond the vertical edge of said lock plate which mates adjacent one edge of said housing.

3. A concealed theft-resistant locking system as recited in claim 1 or 2 wherein the access door system is a pair of outwardly swingng doors, said locking system further comprising:

a cam lock follower bar vertically disposed and slidably mounted within each access door; and biasing means positioned to disengage said follower bar from the upper door frame cavity in response to releasably pivoting said lever;

said follower bar, when the swinging door is closed, operably positioned within lock door above said cam lock so as to be vertically lifted by said cam lock upper edge profile as said cam lock is rotated by said lever to engage the door locking cavity;

said follower bar, when the swinging door is closed, lockably engaging a mating cavity in the container upper horizontal door frame when said follower bar is so lifted;

said biasing means positioned between the horizontal transverse container frame member above the doors and said follower bar.

4. A concealed theft-resistant locking system as recited in claim 1 or 2 wherein the access door system is at least one roll-up type door and:

said cam lock includes a slot which, when the roll-up door is closed, lockably engages a horizontal cross bar integral to the locking cavity in the lower edge of the door when said cam lock is rotated by said lever to engage the door locking cavity.

* * * * *